United States Patent [19]

Gauffin et al.

[11] Patent Number: 4,634,347

[45] Date of Patent: Jan. 6, 1987

[54] ARRANGEMENT IN PLANT EQUIPMENT FOR SUPPLYING A BINDING AGENT DIRECTLY TO A BUILDING ELEMENT

[75] Inventors: Ulf Gauffin, Upsala; Björn Söderlund, Huddinge, both of Sweden

[73] Assignee: Allman Byggnadsservice AB ABS, Sweden

[21] Appl. No.: 728,402

[22] Filed: Apr. 29, 1985

[30] Foreign Application Priority Data

May 3, 1984 [SE] Sweden ..... 8402384

[51] Int. Cl.[4] ..... F04B 15/02; F04B 49/02

[52] U.S. Cl. ..... 417/45; 417/305; 417/540; 417/900; 222/108; 141/116

[58] Field of Search ..... 417/317, 540, 305, 45, 417/900; 222/108; 141/116

[56] References Cited

U.S. PATENT DOCUMENTS

| | | | |
|---|---|---|---|
| 650,176 | 5/1900 | Holmes | 141/116 X |
| 1,368,934 | 2/1921 | Jackson | 141/116 |
| 2,545,278 | 3/1951 | Head | 417/900 X |
| 2,734,462 | 2/1956 | Schaefer | 417/540 |
| 3,279,383 | 10/1966 | Smith | 417/317 X |
| 3,874,417 | 4/1975 | Clay | 417/540 X |
| 4,173,430 | 11/1979 | Kubota | 417/53 |
| 4,254,806 | 3/1981 | Elsworth | 141/116 |

*Primary Examiner*—Carlton R. Croyle
*Assistant Examiner*—Theodore W. Olds
*Attorney, Agent, or Firm*—Kinzer, Plyer, Dorn & McEachran

[57] ABSTRACT

The invention relates to an arrangement in plant equipment for directly supplying to a building element a binder comprising, for example, mortar of pumpable consistency and containing water. The plant equipment includes a vessel for ready-mixed binder, a motor-driven pump and a pump conduit (3) for supplying binder under pressure to a nozzle (4). In order to prevent liquid from being expelled from the binder when the pump is stopped, so as to leave a dry plug in the nozzle, means (18) are provided for maintaining the pressure in and adjacent the nozzle (4) at a level which coincides at least substantially to atmospheric pressure.

5 Claims, 3 Drawing Figures

Figure 1:
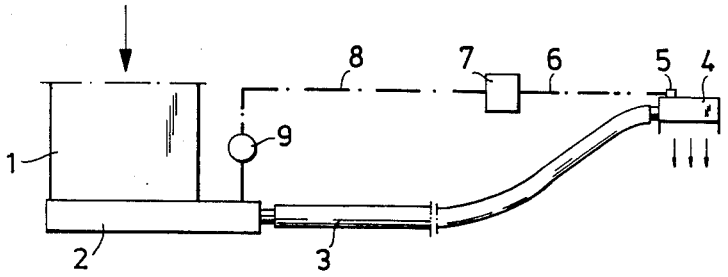

ARRANGEMENT IN PLANT EQUIPMENT FOR SUPPLYING A BINDING AGENT DIRECTLY TO A BUILDING ELEMENT

The invention relates to an arrangement in plant equipment for supplying directly to a building element or structural component a binding agent comprising mortar, mortar size, filler or the like having a pumpable consistency and containing liquid, said plant equipment including a container for a ready-mixed binder, a pump and a pump conduit means for transferring binder under pressure to a nozzle.

Such apparatus have been used in recent times for producing from dry mortar a pumpable mortar which can be applied directly onto building bricks for example. The dusty dry mortar, which to some extent is harmful to the health, is delivered to the working site in an industrial truck herefor and is blown by compressed air into a silo without dust escaping to atmosphere. Located in the bottom of the silo is a smaller container which is fitted with a valve for controlling the flow of mortar from the silo. Subsequent to filling the smaller container the dry mortar is conveyed with the aid of compressed air through a hose to the consumer station, more specifically to a closed mixer in which the mortar is mixed with a given quantity of water. The mixed mortar is transferred from the mixer to a vessel having agitating means arranged therein. In the bottom region of the vessel there is provided a pump, suitably a screw pump by means of which the ready-mixed mortar is pumped under pressure to a pump conduit means, suitably in the form of a reinforced rubber or plastics hose. Because the mortar is agitated it is constantly held fresh and the mortar supplied to a manually operated mortar nozzle through the conduit means thus has the best possible consistency.

Automatically operating plant equipment of this kind have the advantage that the formation of dust is totally avoided and that the mortar sprayed through the nozzle has the desired consitency, thereby to ensure a good bond between building bricks or like building elements for example.

One serious disadvantage with plant equipment of this kind, however, is the interruptions occurring in the ejection of mortar from the hand operated nozzle due to the closure of a valve mounted therein. The nature of the mortar makes it practically impossible to achieve a completely tight or sealed valve and consequently when the valve is closed there is built-up in the end of the hose connected to the valve a pressure which substantially exceeds atmospheric pressure. As mortar is pumped through the hose, with the valve subsequently open, the pressure prevailing in this end of the hose and in the nozzle only exceeds atmospheric pressure by a negligible amount. This high pressure-build-up in the aforesaid hose end, which occurs despite stopping the pump and closing the valve at the same time, is largely due to the fact that the conduit means, which at least in the proximity of the nozzle comprises a flexible hose, lies under a high pressure in a region nearest the pump, this pressure progressively decreasing towards the nozzle, and irrespective of the type of hose used it will dilate somewhat under the influence of the high pressure. When the pump is stopped and the valve closed the pressure in the hose is maintained for a relatively long period of time, since a tendency towards a reduction in pressure is counteracted by the attempt made by the hose to return to its original, unloaded cross-sectional area. The aqueous binding composition, which is here assumed to be mortar and which lies closest to the closed valve, will therefore be subjected to pressure above atmospheric pressure for a long period of time, which means that water will be forced past the valve surfaces, which as beforesaid are not fully sealing, and the binder composition will solidify or harden relatively quickly to form a plug which makes it impossible for further binder to be fed through the nozzle when reopening the valve. In order to prevent such plugs from forming it is therefore necessary to open the valve at short intervals, resulting in the waste of valuable binder. It is not possible with this technique to prevent plugs from forming when the system is unavoidably shut down for long periods, e.g. during lunch breaks, and it is then necessary to clean the hose before work can be commenced. The task of cleaning the hose is both laborious and time consuming. In an attempt to overcome these problems it has been proposed that the closure valve be removed and the mortar allowed to run slowly forward and therewith equalize the pressure in the conduit. This simply results in the solidication of mortar in the nozzle, however.

Consequently, a prime object of the invention is to provide an arrangement which will fully remove the problem of plug formation. This object is realized fully by means of the invention set forth in the following claims.

Figure 2:
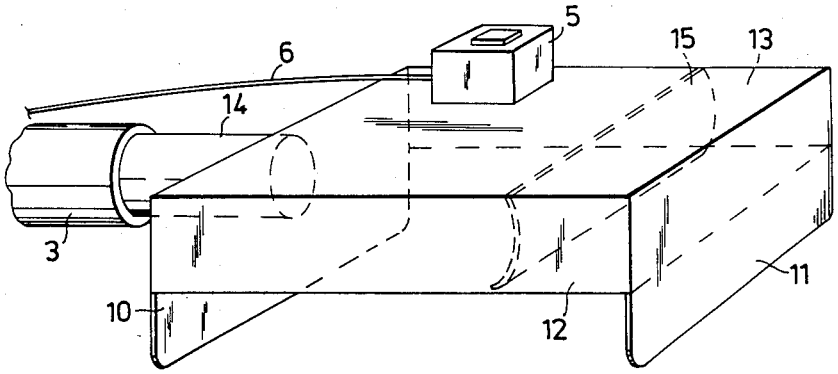
Figure 3:
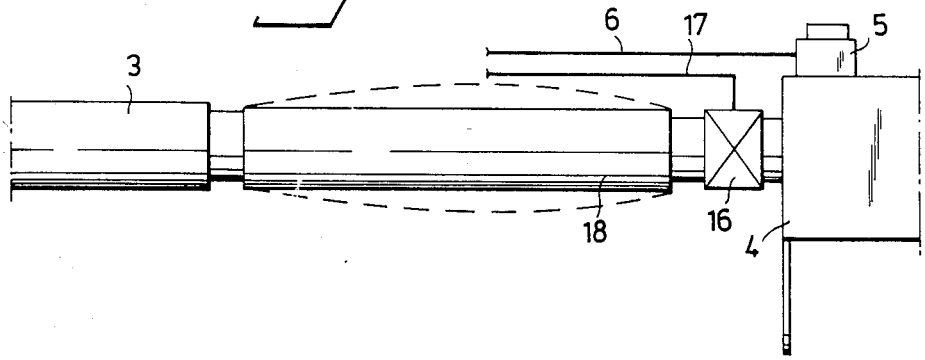

The invention will now be described in more detail with reference to an embodiment thereof illustrated in the accompanying drawing, in which FIG. 1 illustrates in a simplified manner part of a plant for spraying mortar with the aid of an arrangement according to the invention;

FIG. 2 illustrates in a simplified manner the nozzle of FIG. 1 provided with a pump operating button; and FIG. 3 illustrates in a simplified manner an embodiment of the invention incorporating a valve.

FIG. 1 illustrates the aforementioned mixer 1 having agitating means (not shown) and to which mortar is supplied in the direction shown by the arrow. Arranged in the lower part of the mixer 1 is a screw pump 2 or some other pump means suitable for pumping mortar or the like to a conduit 3, which in the illustrated embodiment comprises a flexible reinforced rubber or plastics hose, through which the mortar is pumped to a nozzle 4 and leaves the nozzle in the direction of the arrows. The pump 2 is arranged to impart to the mortar in the conduit 3 a sufficiently high pressure for the mortar to flow evenly through the nozzle 4. In the case of a conduit having a length of 7–8 meters, the pump pressure may be 6–10 bars, to fall to a level slightly above atmospheric pressure in the vicinity of the nozzle 4. The nozzle 4 of the illustrated embodiment is provided with a finger-operated control switch 5, which when activated causes a signal to be sent to a control center 7 which controls the pump motor 9, over a line 8, the motor being of the reversible type. The control centre 7 is adapted to start the pump drive motor 9 upon receipt of the first signal, so as to feed mortar or some other aqueous binder in the conduit 3, and upon receipt of the next signal to stop and then reverse the motor 9, so that the pump withdraws mortar from the conduit 3 over a period of some seconds and reduces the pressure in the mortar located in the nozzle 4, therewith preventing water from being expelled from the nozzle and forming a solid plug. This withdrawal of mortar by suction enables the slightly dilated hose to return to its original dimensions without this contraction of the conduit resulting in the aforesaid increase in pressure in the vicinity of the nozzle.

The nozzle 4 shown in FIG. 1 is illustrated more clearly in FIG. 2 and comprises substantially a downwardly open box having two opposing side walls 10 and 11 which are slightly higher than the two intermediate walls 12 and 13. The lower edges of the walls 10 and 11 form supports for the building element, for example a brick or a slab onto which a string of binder is to be deposited. The wall 10 is provided with a pipe stub 14 connected to the hose 3. Binder forced into the nozle interior comes into contact with a guide plate 15 and is conducted downwardly.

FIG. 3 illustrates a preferred embodiment of the invention in which the nozzle 4 is provided with a valve 16, which in the illustrated embodiment is a electromagnetic valve and which when the motor 9 is stopped by the aforedescribed control center 7 obtains a closure signal on a line 17 thereby interrupting the flow of binder to the nozzle 4. Although the motor 9 of the FIG. 3 embodiment can be reversed for a short period of time in order to withdraw binder in the conduit as described with reference to FIG. 1, such reversal is not necessary in the FIG. 3 embodiment due to the fact that there is arranged adjacent to the nozzle valve 16 a pressure equalizing means 18 in the form of a length of hose made of a stretchable or extensible material, such as non-reinforced rubber. This hose length 18, which borders on the valve 16 or in any event lies tightly against the same, will lie at substantially the same pressure as the nozzle 4 when binder is pumped through the conduit 3 and the hose length 18, i.e. at a level slightly above atmospheric pressure, and has then substantially the form shown in full lines. When the valve 16 is closed the propagation of pressure from the parts of the conduit located nearest the pump 2 will be taken-up by the extensible hose length 18, which then dilates to the form illustrated by broken lines in FIG. 3, i.e. the extent to which the pressure exceeds atmospheric pressure is negligible and is not sufficient to force from the binder water or any other liquid contained therein in a manner to form a more or less solid plug. It will be understood that the stretchable expansion means need not necessarily have the form of a radially expandable hose 18, but may also have the form of an axially stretchable means.

We claim:

1. A mechanism for supplying mortar-like materials of a pumpable slurry consistency which contain liquid, including: a container (1) for the liquid containing mortar-like material, a pump (2) driven by a motor (9), a slightly expandable hose (3) connecting the pump (2) to a closable nozzle (4), characterized in that manually operable means (5, 6) are provided for stopping the motor (9) driven pump (2) and for closing the nozzle (4) and that means (7, 9, 18) are provided for preventing the overpressure in the expanded hose (3) from being transferred to the closed nozzle (4) due to contraction of the hose when the nozzle is closed and the pump stopped, thereby preventing the pressure of the liquid-containing material in the nozzle to rise to a value substantially above atmospheric pressure causing separation in the nozzle of liquid from the mortar-like material.

2. An arrangement according to claim 1, characterized in that said means includes a control circuit (7) arranged to briefly reverse the drive motor (9) of the pump (2).

3. An arrangement according to claim 1, characterized in that said means includes an expandable conduit part (18) connected adjacent a closure valve (16) coacting with the nozzle (4).

4. An arrangement according to claim 3, characterized in that the expandable conduit part comprises a radially extensible hose (18).

5. An arrangement according to claim 2 characterized in that said means includes an expandable conduit part (18) connected adjacent a closure valve (16) coacting with the nozzle (4).

* * * * *